US005377748A

United States Patent [19]

Gayaut

[11] Patent Number: 5,377,748

[45] Date of Patent: Jan. 3, 1995

[54] SPILL CONTAINER FOR WELLS WITH IMPROVED MOUNTING

[75] Inventor: Gilbert A. Gayaut, Sugarland, Tex.

[73] Assignee: Pool Company, Houston, Tex.

[21] Appl. No.: 126,070

[22] Filed: Sep. 23, 1993

[51] Int. Cl.[6] ..... E21B 33/08

[52] U.S. Cl. ..... 166/81; 166/95; 166/162

[58] Field of Search ..... 166/79, 81, 358, 84, 166/88, 75.1

[56] References Cited

U.S. PATENT DOCUMENTS

| | | | |
|---|---|---|---|
| 113,638 | 4/1871 | Dewey . | |
| 560,986 | 5/1896 | Grow . | |
| 819,978 | 5/1906 | Caudle . | |
| 970,880 | 9/1910 | Bouchet . | |
| 1,334,678 | 3/1920 | Riley | 166/75.1 |
| 1,390,793 | 9/1921 | Kyle et al. . | |
| 1,398,814 | 11/1921 | Tanenbaum . | |
| 1,418,612 | 6/1922 | Beard . | |
| 1,448,172 | 3/1923 | Wellensiek . | |
| 1,448,243 | 3/1923 | Wilson . | |
| 1,507,628 | 9/1924 | Schuyler | 166/88 |
| 1,547,461 | 7/1925 | Steele . | |
| 1,809,175 | 6/1931 | Loomis . | |
| 1,811,761 | 6/1931 | Roberts . | |
| 1,867,030 | 7/1932 | Roberts | 166/358 |
| 2,077,044 | 4/1937 | Grace et al. | 166/358 |
| 2,137,832 | 11/1938 | Cordes . | |
| 2,145,192 | 1/1939 | Pennington . | |
| 2,522,444 | 9/1950 | Grable . | |
| 2,610,690 | 9/1952 | Beatty . | |
| 2,716,019 | 8/1955 | Shacikoski . | |
| 2,792,199 | 5/1957 | Becker et al. . | |
| 2,884,067 | 4/1959 | Marken . | |
| 2,886,288 | 5/1959 | Gehrke . | |
| 3,023,808 | 3/1962 | John | 166/79 |
| 3,173,502 | 3/1965 | Overby . | |
| 3,187,238 | 6/1965 | Wilson et al. . | |
| 3,270,810 | 9/1966 | Johnston . | |
| 3,322,198 | 6/1967 | McHenry . | |
| 3,353,606 | 11/1967 | Dyer . | |
| 3,355,188 | 11/1967 | Knickelman et al. . | |
| 4,029,160 | 6/1977 | Leidvik . | |
| 4,042,048 | 8/1977 | Schwabe . | |
| 4,276,945 | 7/1981 | Ward, Sr. . | |
| 4,406,331 | 9/1983 | Bentley . | |
| 4,450,905 | 5/1984 | Crain . | |
| 4,665,976 | 5/1987 | Retherford . | |
| 4,809,791 | 3/1989 | Hayatdavoudi . | |
| 4,878,576 | 11/1989 | Dietzen . | |
| 4,942,929 | 7/1990 | Malachosky et al. . | |
| 4,949,784 | 8/1990 | Evans | 166/81 |
| 5,121,794 | 6/1992 | Hibdon et al. . | |
| 5,121,796 | 6/1992 | Wigington, Sr. | 166/81 X |
| 5,150,751 | 9/1992 | Burton et al. . | |
| 5,211,244 | 5/1993 | Arterbury | 166/81 X |
| 5,228,506 | 7/1993 | Pearce | 166/81 |

*Primary Examiner*—Michael Powell Buiz
*Assistant Examiner*—Frank S. Tsay
*Attorney, Agent, or Firm*—Crutsinger & Booth

[57] ABSTRACT

A spill preventing device for use on a tubular portion of a well head is provided. The device has at least two sections forming an open-topped container with a bottom, the container being of a size to receive spills around the well. The container sections have a central opening in the bottom of the container of a size to fit around a tubular portion of a well head. An upstanding centrally located cylindrical flange is provided to fit around the tubular member. The flange is formed with upwardly extending walls from the container sections, which are releasably connected together to form the flange. A splash suppression assembly is positioned in the open-topped container to prevent liquid from splashing out. The splash suppression assembly has a plurality of rings mounted above the bottom of the container. The rings are concentrically positioned about the central cylindrical flange.

10 Claims, 6 Drawing Sheets

SPILL CONTAINER FOR WELLS WITH IMPROVED MOUNTING

TECHNICAL FIELD

The present inventions relate to spill containers for wells and more particularly to methods and configurations for their mounting on wells.

BACKGROUND OF THE INVENTIONS

It is of course important to minimize spillage of fluids around both land based and off-shore wells. The problem with regard to both types of wells is identical in that spilled well fluids can cause pollution. With off-shore wells, the fluids can pollute the water surrounding the well; with on-shore wells the soil around the well, and in some cases the ground water also, can be polluted. The problem is particularly present with oil and gas wells and other wells dealing with harmful and hazardous materials.

As a consequence of drilling and servicing wells, fluids containing hydrocarbons and other chemicals are released and spilled from the well casing. For example, during drilling, pulling drill pipe from the well bore can release drilling mud containing hydrocarbons and other chemicals. In the reworking of wells pulling production tubing from the wells can likewise spill liquids. While swabbing (cleaning out) wells, fluids can be forced to the surface in large volumes, resulting in spills.

Minimizing spills around oil wells and the advantages of doing so have long been recognized. As early as 1871 inventions were patented for gathering the oil from well tubes as they are being withdrawn from the wells. The structures were called by various names including, catchers, pans, basins, containers and the like, and all function to prevent spills. U.S. Pat. No. 113,638 to Dewey, issued Apr. 11, 1871 shows this technology is almost as old as oil wells. As the oil industry progressed, refinements were made in the devices for catching spilled fluids around a well. For example, U.S. Pat. No. 1,448,172 to Wellensiek, issued Mar. 13, 1923 shows a spill catcher mounted on the outside of the oil well casing. In the 1924 patent to Schuyler, U.S. Pat. No. 1,507,628, a spill catcher is shown clamped on the outside of the casing. The spill catcher is formed in multiple sections with flanges and seals between the sections for ease in installation on and removal from the outside of the casing.

In off-shore applications such as the United States Patents to Roberts (U.S. Pat. No. 1,811,761, issued Jun. 23, 1931 and U.S. Pat. No. 1,867,030, issued Jul. 12, 1932), and to Grace (U.S. Pat. No. 2,077,044, issued Apr. 13, 1937), spill pans and structures located below the drill floor are shown for catching spilled liquids. The Roberts' patent '761 describes utilizing a pump to remove the oil and drilling mud from the pan. Roberts' '030 discloses pipe 46 and pump 47 for collecting the spilled fluids. The structure in the Grace patent '044 has a compressible seal clamped around the casing (FIG. 7) and a drainpipe 38 connected to a suitable sump or pump to remove fluids from the catch basin.

The 1962 to St. John, U.S. Pat. No. 3,023,808 and the 1990 U.S. Pat. No. 4,949,784, to Evans, shows structures mounted on the outside of the well. U.S. Pat. No. 5,121,794, to Hibdon, et al., issued Jun. 16, 1992 describes a structure that has a flange integrally formed in the bottom thereof so that it can be bolted into the well structure between a pair of opposed interfacing flange surfaces. U.S. Pat. No. 5,121,796, to Wigington, issued Jan. 16, 1992 shows a catch device which is bolted to a plate which is in turn welded to the outside of a piece of casing bolted into the well.

Thus, the problem and many proposed solutions have existed.

SUMMARY OF THE INVENTIONS

The present inventions contemplate improvements in the devices and methods utilized for preventing polluting spills around on-shore and off-shore wells. The improved spill preventing device is designed in sections so that it can be assembled installed around a casing or other tubular portion of the well before dismantling or disassembling the well head. In this way the device can be installed before disassembly of the well head to catch fluids released during the disassembly process. The improved spill device need not be bolted into the well string nor have special mounting structure. This avoids spills which may occur during disassembly of the well head. The sections have a central opening of a size to fit around a tubular portion of the well head. Each section is designed to be assembled so that a sealed, open topped pan or container is formed. An upstanding central cylindrical flange is provided to fit around the tubular member. Using the upstanding cylindrical flange for mounting makes mounting easy, quick, and somewhat universal. A splash suppression assembly is positioned in the pan to prevent liquid, from splashing out of the pan. The splash suppression assembly has a plurality of rings mounted above the bottom of the pan. An optionally removable skirt can also be provided to extend the effective depth of the pan to reduce spills. The loose fit around the tubular member allows the pan to be rotated to properly position it out of the way of other well operations. A gasket or cap can be provided to close the annular space created by the loose fit. A drain is provided for flowing the liquid to a tank. Optionally a pump can be placed in the line between the catch pan and the tank to assist the spilled fluids in flowing to the tank.

BRIEF DESCRIPTION OF THE DRAWINGS

The accompanying drawings form a part of the specification. These drawings together with the description serve to explain the principles of the inventions. The drawings are included only for the purpose of illustrating examples of how the inventions can be made and used and are not to be construed as limiting the inventions to only those examples which are illustrated and described therein.

The various advantages and features of the present inventions will be apparent from a consideration of the drawings in which.

DETAILED DESCRIPTION

Figure 1:
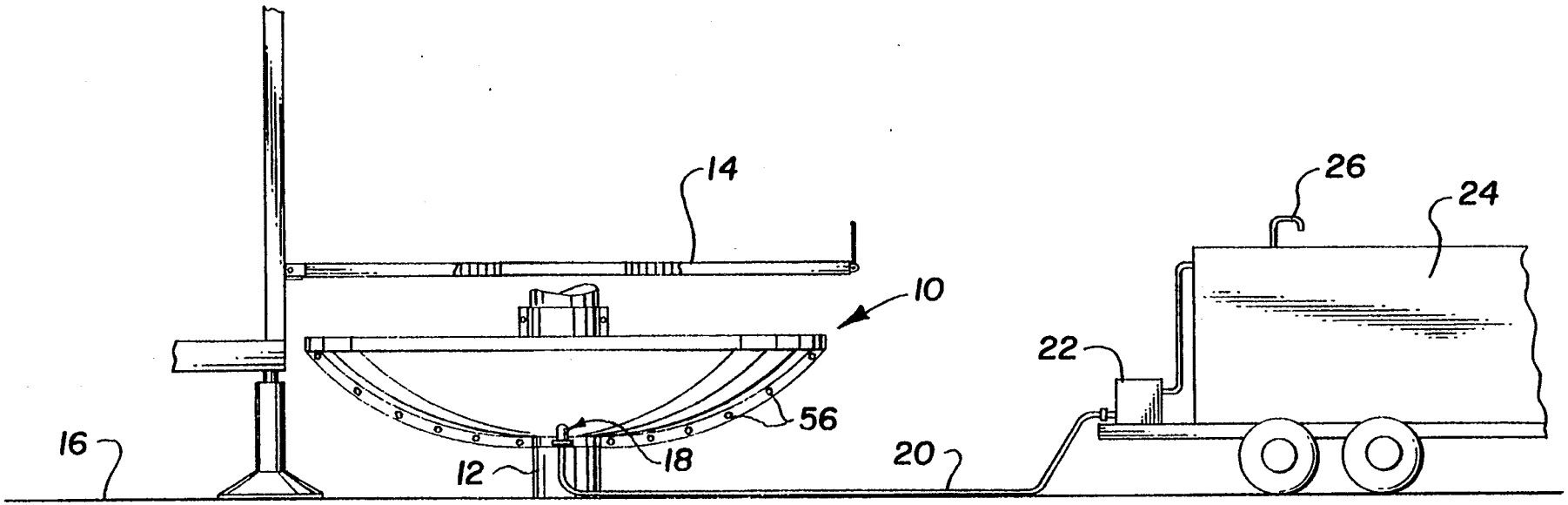
FIG. 1 illustrates a side elevation of one example of a construction of an improved spill container in accordance with the present invention.

The present inventions will be described by reference to drawings showing examples of how the inventions can be made and used. In these drawings reference characters are used throughout the several views to indicate like or corresponding parts.

FIG. 1 illustrates one embodiment or example of an apparatus in the form of an improved spill pan or container. In the description the container is identified by reference number 10. The details of the construction and method of use of the container 10 are illustrated in FIGS. 1 through 6. In these Figures container 10 is shown assembled around a tubular member 12 which as illustrated can form a part of the oil well assembly. As will be described, the improved spill container 10 is designed to fit around a variety of types of tubular members such as oil well casing, oil well pipe, and equipment attached to the casing having annular portions such as the wellhead of the oil well, well spools, blow-out preventers and the like. These tubular sections can have end connections which are either threaded, flanged, clamped, welded or the like. One advantage of the container of the present invention is that it can be installed on any well member with external tubular surfaces, without regard to the type of end connections and without the necessity of disassembling the well head. Preferably when installed, the container 10 is positioned below the work floor 14 of an oil well service rig (not shown) and above the surface 16 of the water or ground around the oil well.

Figure 2:
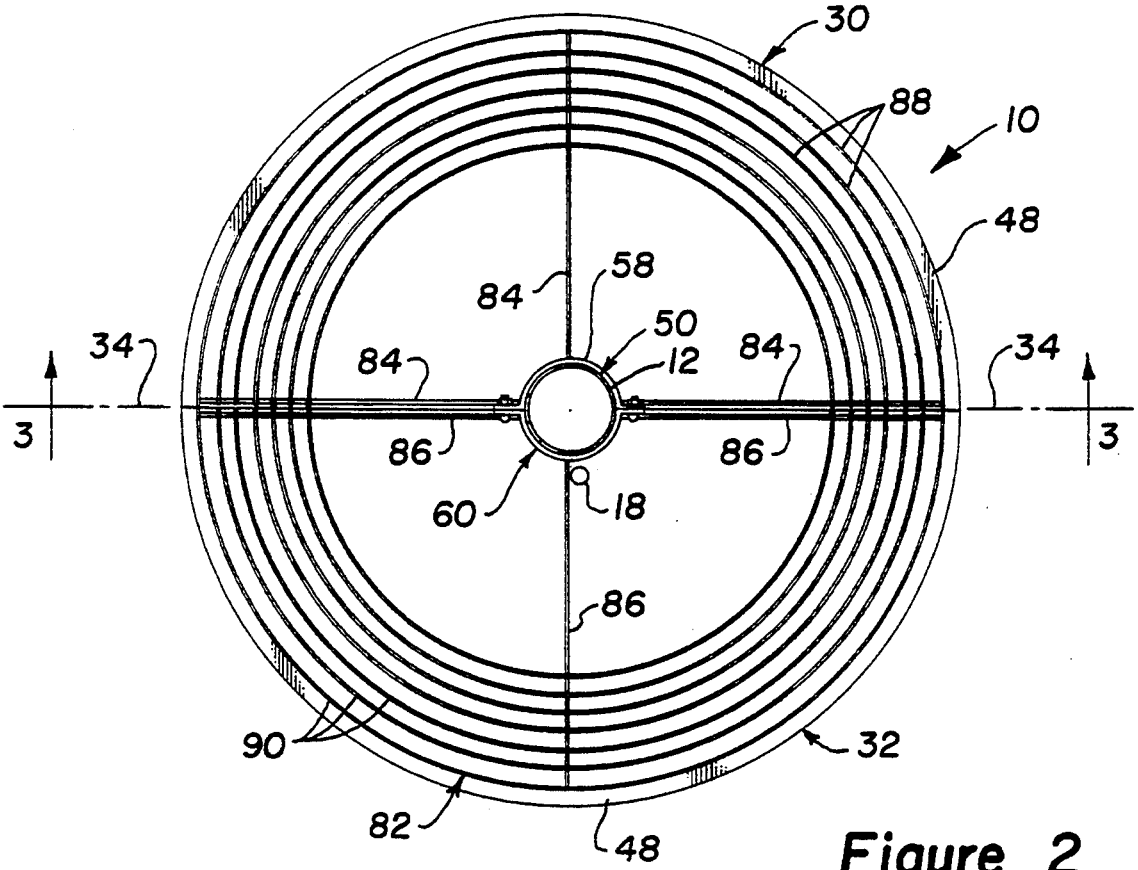
FIG. 2 is a top view partially in section illustrating the example shown in FIG. 1.

Container 10 has the general shape of an inverted concave pan and is provided with an open top for catching spilled fluid and has a drain 18. In FIG. 2 the container is shown with a circular base. However, as described herein other base shapes could be utilized. Conduit 20 is connected between drain 18 and a collection or storage tank 24. In some environments spilled fluid will flow from the container 10 to the tank 24 by force of gravity. However, a suitable pump 22 can be provided in the conduit 20 to force flow to the tank. The tank 24 can be vented 26 to atmosphere through a filter (not shown) or the like.

In operation, fluids are spilled into the container 10. The fluids flow through conduit 20, either by gravity or through pump 22 and are collected in accumulation tank 24 where they can later be removed and properly disposed of.

Figure 3A:
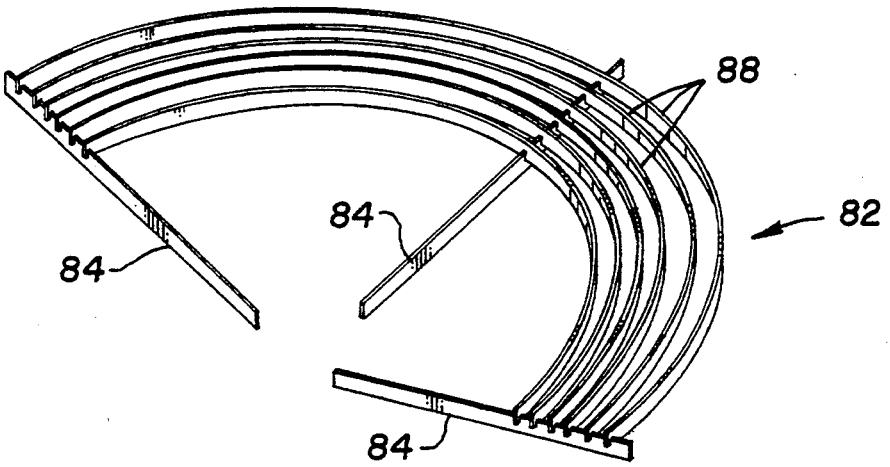
FIG. 3*a* is a perspective view of the splash suppression assembly.
Figure 3:
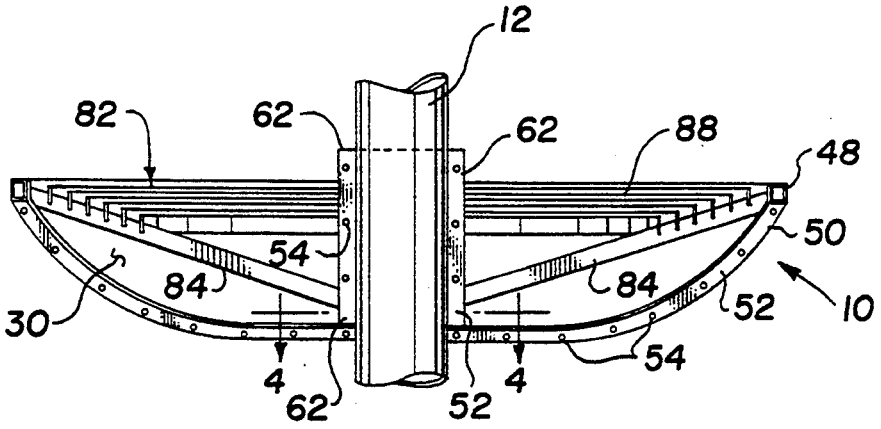
FIG. 3 is a partial section view similar to FIG. 2, taken along lines 3—3 of FIG. 2 looking in the direction of the arrows.
Figure 4:
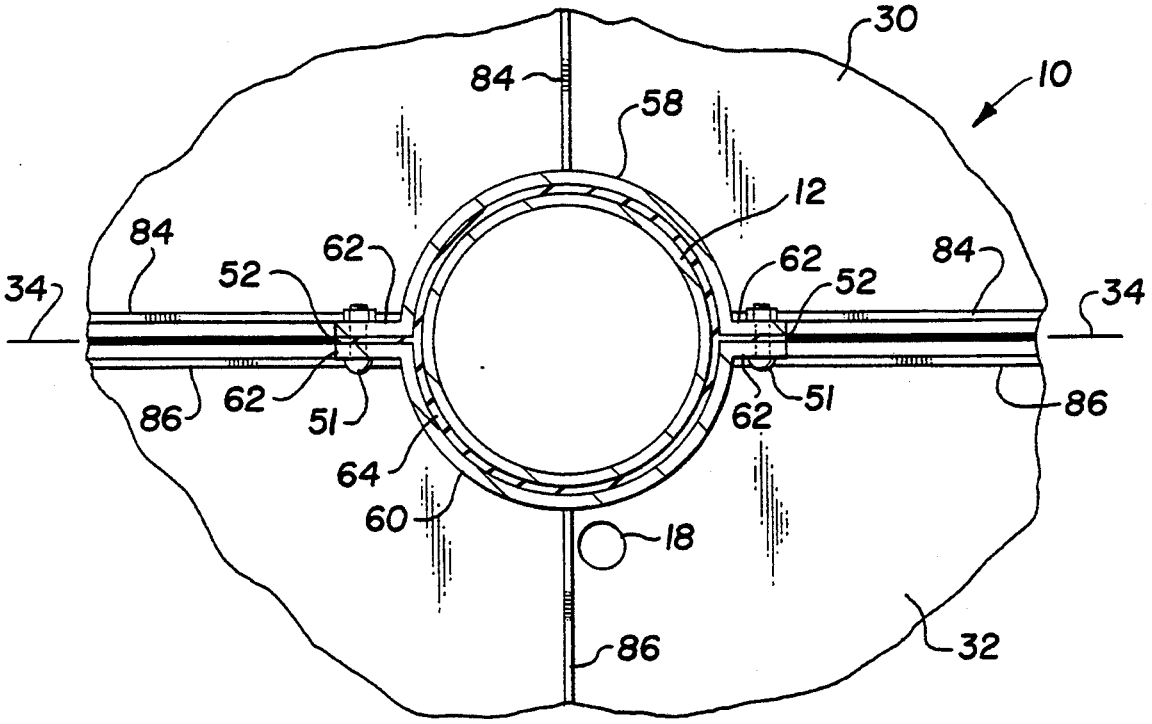
FIG. 4 is a partial section view taken on lines 4—4 of FIG. 3 looking in the direction of the arrows.
Figure 3B:
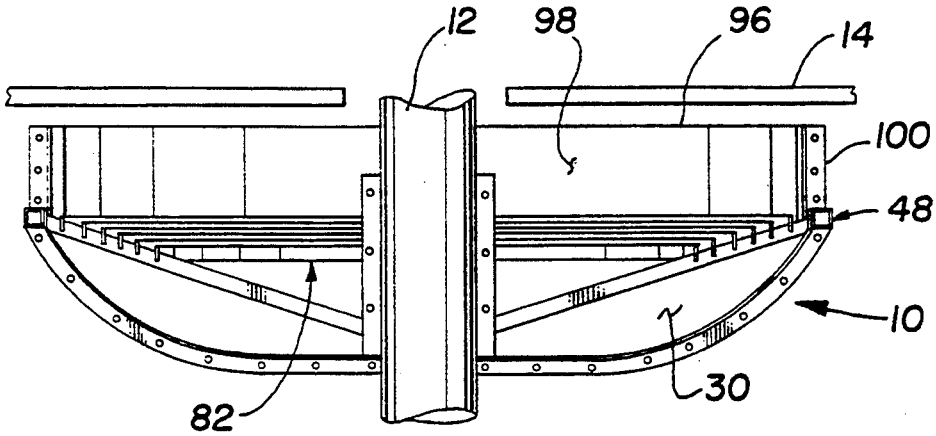
FIG. 3*b* is a partial section similar to FIG. 3 showing the optional skirt assembly installed on the spill container of FIG. 1.
Figure 3C:
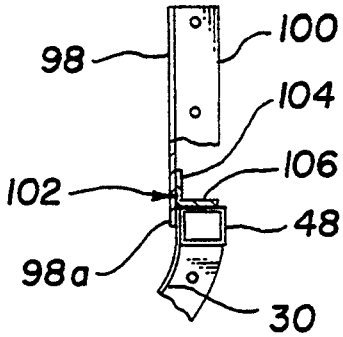
FIG. 3*c* is an enlarged view of a portion of FIG. 3*b;*
Figure 3D:
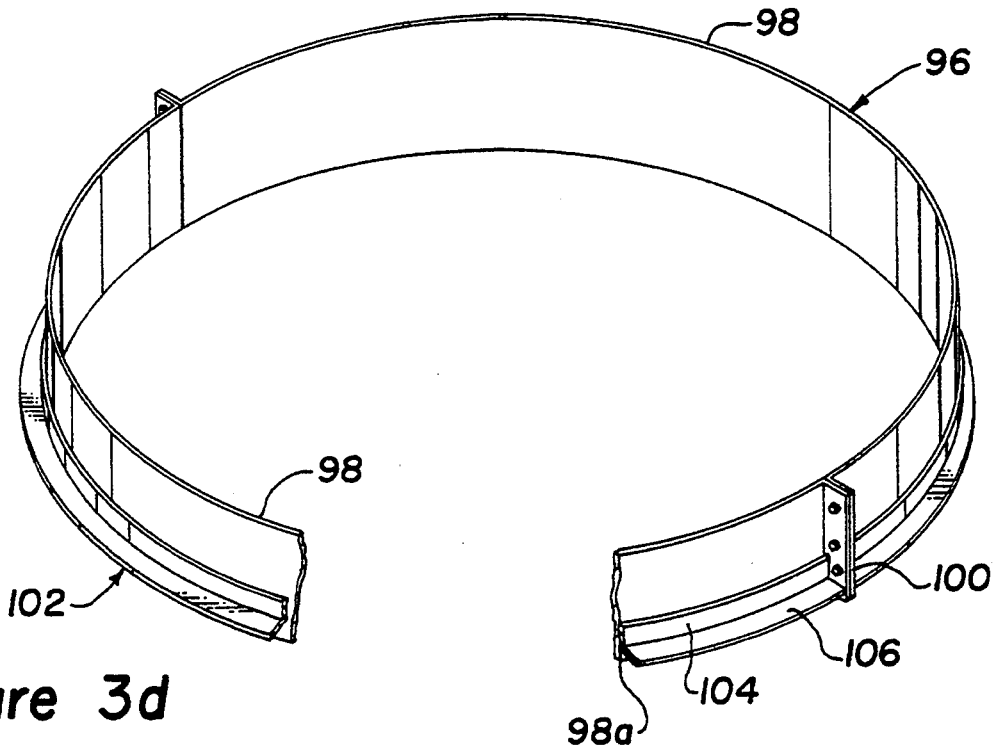
FIG. 3*d* is a perspective view of the skirt assembly.

The details of the construction of the improved container 10 are shown in FIGS. 2–4. Container 10 is constructed in at least two sections 30 and 32. In the top view of FIG. 2 these sections are generally semicircular in shape and are separated by parting line 34. Each of these sections has walls formed from sheet material. My initial container was constructed using a welded metallic construction. However, I would anticipate that my invention can be made by using other materials which are manufactured by means other than welding. I also anticipate that container 10 could be constructed in more than two sections, for example four sections.

Sections 30 and 32 are basically half sections and are mirror images of each other. Where the two sections are adjacent, mounting flanges 50 are provided. As shown in FIG. 3, the interior of the walls of the container preferably taper downward like a funnel from the outside edge to the center to facilitate collection of the fluids at the drain. However, the container could have a partial or completely flat bottom wall, as shown.

For structural purposes, square tubing 48 is attached around the periphery of the half sections 30 and 32. The tubing adds strength and eliminates the sharp edges. This allows the sections to be constructed from lighter (thinner) weight material. It is envisioned of course that other tubing shapes or stiffeners could be utilized to provide structural support. Alternatively, the walls could be made from sufficiently rigid materials to avoid the need of a stiffener.

Flanges 50 are formed on the parting line 34 along the adjacent edges. These flanges are used to connect sections 30 and 32 together. In the illustrated embodiment, compressible gasket material 52 is positioned between the two flanges to provide a seal therebetween. According to the illustrated example, openings or bores 54 are formed in flanges 50 through which suitable fasteners 56 are inserted to assemble sections 30 and 32 together. In the illustrated example threaded bolts are used. Flanges 50 are preferably located outside the container as shown, however they could be located internally. Other removable connectors such as clamps, or the like could be used.

As can be seen in FIG. 2–4, walls on the sections 30 and 32 form a centrally located annular flange. In the embodiment shown, the flange is formed by semi-cylindrical center walls 58 and 60, respectively. Walls 58 and 60 extend from the bottom of the container axially upward to a height of approximately at least that of the edge formed by tubing 48. Flanges 62 are formed along the parting line of cylindrical walls 58 and 60. Flanges 62 are provided with aligned openings 54 through which fasteners 56 pass to connect the sections together. Gasket material 52 can be placed between the flanges 62 to form a seal.

The cylindrical flange is selected to be of a size to loosely fit around the exterior of common tubular well members. The annular gap or loose fit can be packed at the top with suitable gasket material 64 to form a seal. It is also preferable for stability that the cylindrical flange have an axial length at least as great as its internal diameter.

Figure 5:
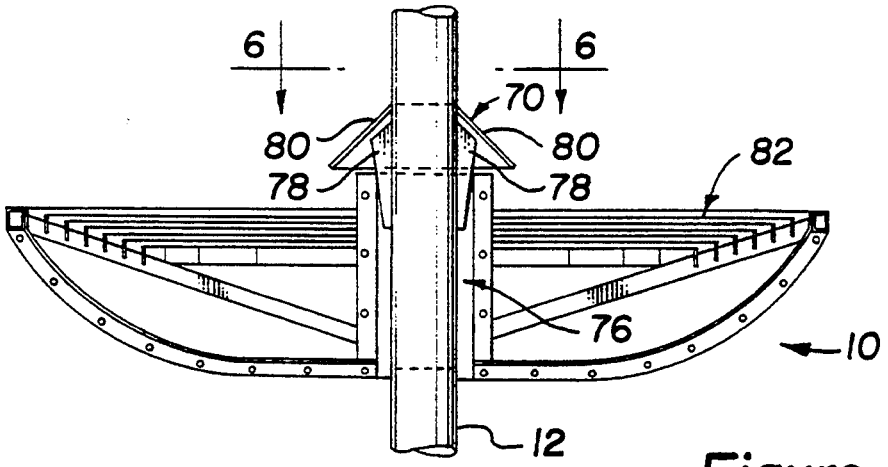
FIG. 5 is a view similar to FIG. 3 showing a cap assembly installed on the spill container of FIG. 1.
Figure 6:
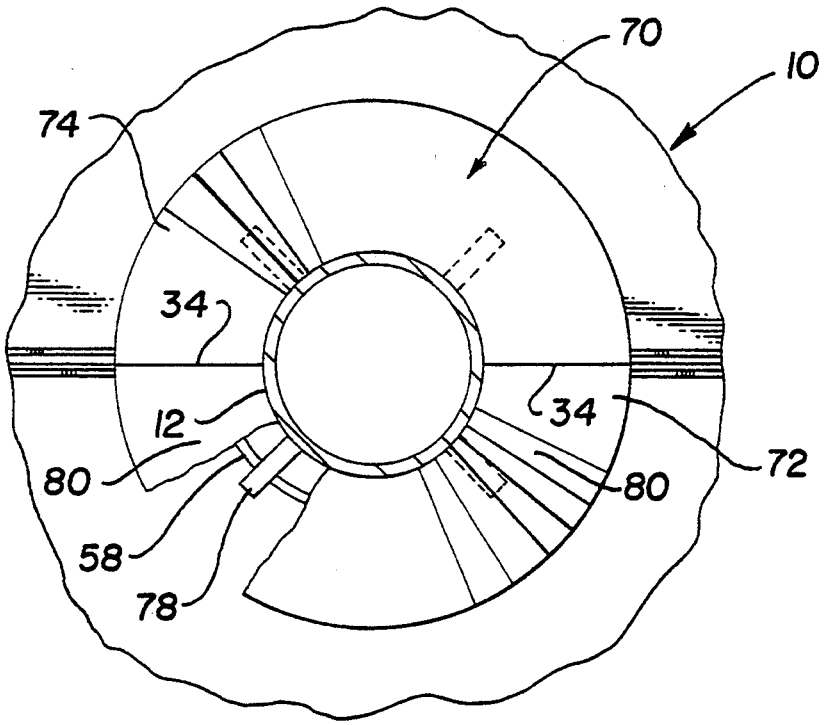
FIG. 6 is a partial section view taken on lines 6—6 of FIG. 5 looking in the direction of the arrows.

In situations where the loose fit is greater, a cap assembly 70 can be mounted as shown in FIGS. 5 and 6. Cap 70 is formed in two sections 72 and 74. Cap 70 can be supported in the annular space 76 by ribs 78 extending down from cap 70. Inclined tops 80 deflects fluids away from the annular space 76 and into the container. Flanges and fastener assemblies (not shown) could be provided on the sections 72 and 74 to connect them together if required.

In FIGS. 2–4 the splash suppression assembly 82 is shown. Assembly 78 is positioned within the container 10 and can either be connected to the container or merely supported therein. Assembly 82 has six spoke members 84 and 86 which extend from the walls 58 to the edge of the container 10 adjacent the tubing 48. As is illustrated in FIG. 4, three spokes 84 are positioned in the section 30 and three spokes 86 are in section 32. A plurality of splash deflector rings 88 and 90 are supported from the spokes 84 and 86, respectively. In the embodiment illustrated the rings are concentrically positioned and are formed from semicircular portions. The number and spacing of the rings is such that, in a thirty inch radius container, six rings equally spaced at one and one-half inch are used. The rings are made from one and one-half inch wide and one-eighth inch bar material. The spokes can be notched three-quarters of an inch to receive the rings. The rings slope down two and three-quarters of an inch from tubing 48.

Additionally, as shown in FIGS. *3b–3d*, a removable skirt assembly 96 can be provided on the container 10 to extend the sides upward closer to the floor 14 to reduce splashing. In the illustrated embodiment, skirt 96 is formed from two semi-cylindrical walls 98 (only one is shown) and joined together by flanges 100 and skirt 96 fasteners (not shown). It is anticipated that the skirt could be made in more than two sections. The skirt 96 is constructed to rest on top of the tubing 48 of container 10. A portion 98*a* of wall 98 extends down along the inside of the wall of section 30. An angle member 102 (see FIGS. *3c–3d*) is fastened to the outside of wall 98 to removably support the skirt 96 on the tubing 48. One leg 104 of angle 102 is fastened to the outside of wall 98 with the other leg 106 extending radially outward to provide supporting contact with the top of tubing 48. It is anticipated that skirts of different heights could be interchanged to accommodate various well situations, or that a flexible, adjustable high skirt could be provided.

The method of using the improved spill container of the present invention involves transporting the various parts to the oil well site for use. Preferably, the two half sections 30 and 32 are assembled at the well site around a suitable tubular member 12 existing on the well. If none of the tubular member of the well can be utilized, a spool can be used to mount the drip pan. In any case the two sections of the drip pan are bolted together around the tubular member and the pan is connected to a tank 24 to collect the spilled liquids into the tank.

Figure 7:
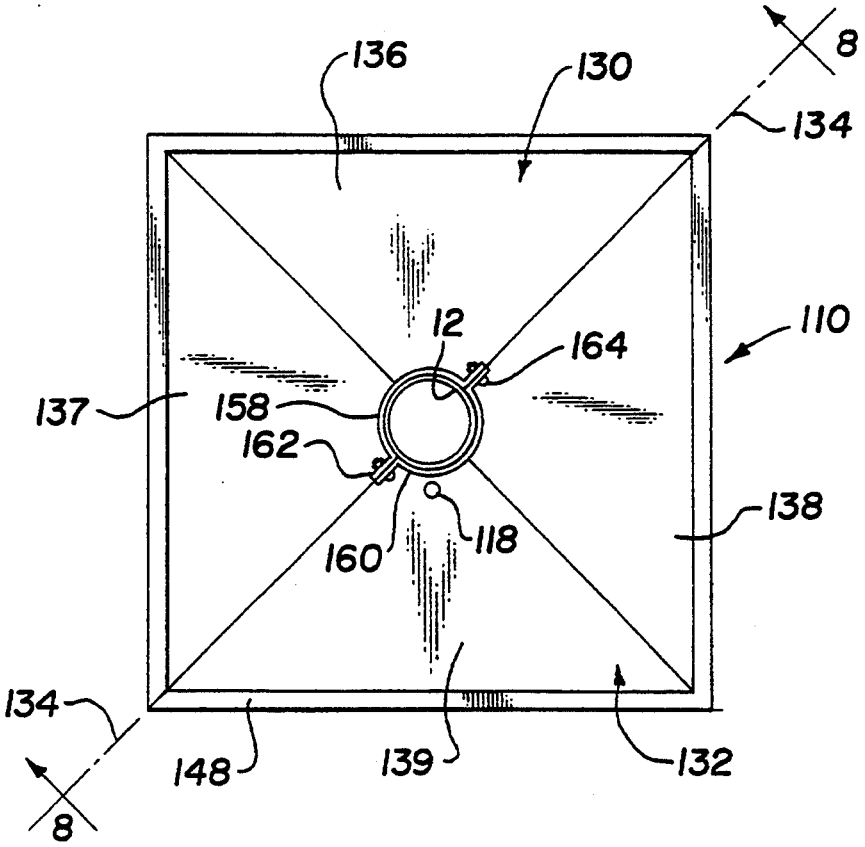
FIG. 7 illustrates a top view of another example of a construction of an improved spill container in accordance with the present invention.

FIG. 7 shows another embodiment or example of an apparatus in the form of an improved spill pan or container 110. Container 110 has the general shape of an inverted four sided pyramid and is provided with an open top for catching spilled fluid and has a drain 118. A conduit is connected between drain 118 and a collection or storage tank 24.

Figure 8:
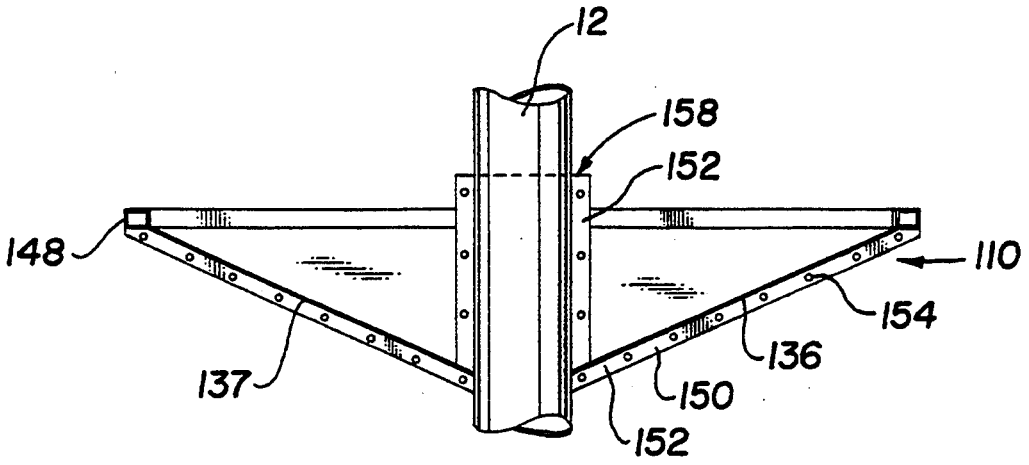
FIG. 8 is an elevation view of the embodiments of FIG. 7 shown partially in section.

The details of the construction of the improved container 110 are shown in FIGS. 7 and 8. Container 110 is constructed in at least two sections 130 and 132. In the top view of FIG. 7 these sections are separated by parting line 134. Each of these sections has walls formed from sheet material of a welded metallic construction. However, I would anticipate that my invention can be made by using other materials which are manufactured by means other than welding. I also anticipate that container 110 could also be constructed in more than two sections. For example, each of the four triangular plates of container 110 could be a separate section. Sections 130 and 132 are basically half sections and are mirror images of each other. Where the two sections are adjacent, mounting flanges are provided to connect the sections together.

As shown in FIG. 8, the interior of the walls of the container taper downward like a funnel from the outside edge to the center to facilitate collection of the fluids at the drain. However, the container could have a partial or completely flat bottom wall. When the pan is assembled as shown in FIG. 7 the bottom of the walls of the pan are formed by four generally triangular shaped flat plates. Plates 136 and 137 are formed in section 130 while plates 138 and 139 are formed in section 132. For structural purposes, tubing 148 is attached around the periphery of the plates. It is envisioned of course that other tubing shapes or stiffeners could be utilized to provide structural support. Alternatively, the walls could be made from sufficiently rigid materials to avoid the need of a stiffener.

As shown in FIG. 8, flanges 150 are formed on the parting line 134 along the adjacent edges of the plates. These flanges are used to connect sections 130 and 132 together. In the illustrated embodiment, compressible gasket material 152 is positioned between the two flanges to provide a seal therebetween. According to the illustrated example, openings or bores 154 are formed in flanges 150 through which suitable fasteners (not shown) are inserted to assemble sections 130 and 132 together. In the illustrated example threaded bolts are used. Flanges 150 are preferably located outside the container as shown, however they could be located internally. Other removable connectors such as clamps, or the like could be used.

As can be seen in FIG. 7–8, walls on the sections 130 and 132 form a centrally located annular flange. In the embodiment shown, the flange is formed by semi-cylindrical center walls 158 and 160, respectively. Walls 158 and 160 extend from the bottom of the container axially upward to a height of approximately at least that of the edge formed by tubing 148. Flanges 162 are formed along the parting line of cylindrical walls 158 and 160. Flanges 162 are provided with aligned openings through which fasteners 164 pass to connect the sections together. Gasket material 152 can be placed between the flanges 162 to seal liquid in container 110. The cylindrical flange is selected to be of a size to loosely fit around the exterior of common tubular members in place on existing wells. The annular gap or loose fit can be packed at the top with suitable gasket material (not shown) to form a seal or a cap as shown in FIGS. 5 and 6 could be used. Alternatively, a splash assembly and/or skirt could be used with these embodiments.

By mounting the container of the present invention without physically bolting or connecting it to the well, the container can be rotated or moved about the tubular member to the proper position to avoid interfering with well operations. In addition, by providing a mounting which can fit around an existing oil well tubular member, disassembly of the well is avoided. In some cases the disassembly of the well itself to install the drip pan causes spills and pollution. These problems are avoided by use of applicant's spill container. In addition, the loose firing assembly on an existing well tubular makes this invention more universal in that it is not required to exactly match a thread or flange bolt configuration.

The embodiments shown and described above are only exemplary. Many details are publicly available in the art, such as, the construction of pumps, tanks and the wellhead itself. Therefore, many such details are neither shown nor described. It is not claimed that all of the details, parts, elements, and/or steps described and shown were invented herein. Even though numerous characteristics and advantages of the present inventions may have been set forth in the foregoing description, together with details of the structure and function of the inventions, the disclosure is illustrative only, and changes may be made in the detail, especially in matters of shape, size and arrangement of the parts within the principles of the inventions to the full extent indicated by the broad general meaning of the terms used the attached claims.

The details of the description and drawings of the specific examples above do not point out what an infringement of this patent would be, but are to provide at least one example of how to make and use the inventions. The limits of the inventions and the bounds of the patent protection are measured by and defined in the following claims:

I claim:

1. A device for use on a tubular portion of a well for reducing spills comprising: at least two sections forming an open-topped container with a bottom, the container being of a size to receive spills around the well, each said section having means thereon for releasably connecting the sections together around the well, means for sealing the sections together to prevent leaks of liquids from the container when the sections are assembled together, and an annular flange centrally located in the bottom of the container of a size and shape to fit around a tubular portion of the well, said annular flange being formed with walls extending upward from said at least two sections, each said wall having means thereon for releasably connecting the walls together around the well tubular portion; means for sealing said center walls together to prevent leaks, and said annular flange having an axial length extending axially upward when said device is installed on a well to a height to prevent liquids in said container from flowing through the annular space between the cylindrical flange and the tubular portion of the well.

2. The device of claim 1 wherein said annular flange is cylindrical.

3. The device of claim 1 additionally comprising a conduit, pump and accumulation tank connected to said container.

4. The device of claim 1 additionally comprising a splash suppressor located within said container.

5. The device of claim 4 which said splash suppressor comprises an array of corrective annular members supported in said container.

6. The device of claim 1 additionally comprising a skirt removably positioned on said container to extend the effective height of the side walls of said container.

7. Environmental well installation comprising a well casing and equipment attached to said casing, an open topped container positioned around said installation, said container having side walls and an exterior rim axially positioned above the bottom of the container, and a centrally located cylindrical flange in the center of said container, said cylindrical flange extending axially from the bottom of said container to an axial height at least as high as the rim on the side walls of said container, at least one drain in the side wall of said container, a conduit connected to the drain, a pump with the intake side connected to the conduit, a tank connected to the discharge of said pump for accumulating liquids pumped from said container, said container comprising at least two sections releasably connected together by flanges along the interface between the two sections, seals between the interfacing surfaces on the two sections, releasable fastener means joining the two sections together.

8. The device of claim 7 additionally comprising a splash suppressor located within said container.

9. The device of claim 8 wherein said splash suppressor comprises an array of concentric annular members supported in said container.

10. The device of claim 7 additionally comprising a skirt removably positioned on said container to extend the effective height of the side walls of said container.

* * * * *